US010230171B2

(12) United States Patent
Apostolos et al.

(10) Patent No.: US 10,230,171 B2
(45) Date of Patent: Mar. 12, 2019

(54) TRAVELLING WAVE ANTENNA FEED STRUCTURES

(71) Applicant: AMI Research & Development, LLC, Windham, NH (US)

(72) Inventors: John T. Apostolos, Lyndeborough, NH (US); Benjamin McMahon, Nottingham, NH (US); Brian Molen, Windham, NH (US); Judy Feng, Nashua, NH (US); William Mouyos, Windham, NH (US)

(73) Assignee: AMI Research & Development, LLC, Windham, NH (US)

( * ) Notice: Subject to any disclaimer, the term of this patent is extended or adjusted under 35 U.S.C. 154(b) by 56 days.

(21) Appl. No.: 15/358,197

(22) Filed: Nov. 22, 2016

(65) Prior Publication Data

US 2017/0141479 A1 May 18, 2017

Related U.S. Application Data

(60) Continuation of application No. 14/734,177, filed on Jun. 9, 2015, now Pat. No. 9,509,056, which is a division of application No. 14/193,072, filed on Feb. 28, 2014, now Pat. No. 9,166,301.

(60) Provisional application No. 61/772,623, filed on Mar. 5, 2013.

(51) Int. Cl.

| | |
|---|---|
| ***H01Q 21/00*** | (2006.01) |
| ***H01Q 13/20*** | (2006.01) |
| ***H01Q 21/06*** | (2006.01) |
| ***H01Q 11/02*** | (2006.01) |
| ***H01Q 3/26*** | (2006.01) |
| ***H01Q 21/08*** | (2006.01) |
| ***H01Q 13/28*** | (2006.01) |
| ***H01Q 21/22*** | (2006.01) |

(52) U.S. Cl.

CPC ..... *H01Q 21/0068* (2013.01); *H01Q 3/2676* (2013.01); *H01Q 11/02* (2013.01); *H01Q 13/28* (2013.01); *H01Q 21/0043* (2013.01); *H01Q 21/061* (2013.01); *H01Q 21/068* (2013.01); *H01Q 21/08* (2013.01); *H01Q 21/22* (2013.01)

(58) Field of Classification Search

CPC .... H01Q 13/20; H01Q 21/0068; H01Q 21/22; H01Q 21/0043; H01Q 21/061; H01Q 21/068; H01Q 21/08; H01Q 3/2676; H01Q 11/02; H01Q 13/28

See application file for complete search history.

(56) References Cited

U.S. PATENT DOCUMENTS

| | | | | |
|---|---|---|---|---|
| 9,246,230 | B2 * | 1/2016 | Apostolos | H01Q 13/28 |
| 2012/0274528 | A1 * | 11/2012 | Apostolos | H01Q 13/20 343/785 |

* cited by examiner

*Primary Examiner* — Hoang V Nguyen

(74) *Attorney, Agent, or Firm* — VLP Law Group, LLP

(57) ABSTRACT

Techniques for implementing series-fed antenna arrays with a variable dielectric waveguide. In one implementation, coupling elements with optional controlled phase shifters are placed adjacent each radiating element of the array. To avoid frequency sensitivity of the resulting array, one or more waveguides have a variable propagation constant. The variable waveguide may use certain materials exhibiting this phenomenon, or may have configurable gaps between layers. Plated-through holes and pins can control the gaps; and/or a 2-D circular or a rectangular travelling wave array of scattering elements can be used as well.

6 Claims, 16 Drawing Sheets

TRAVELLING WAVE ANTENNA FEED STRUCTURES

CROSS-REFERENCE TO RELATED APPLICATIONS

The present application is a continuation of U.S. patent application Ser. No. 14/734,177, which was filed on Jun. 9, 2015, by John T. Apostolos et al. for TRAVELLING WAVE ANTENNA FEED STRUCTURES which is a divisional of U.S. patent application Ser. No. 14/193,072, which was filed on Feb. 28, 2014, by John T. Apostolos et al. for TRAVELLING WAVE ANTENNA FEED STRUCTURES which claims the benefit of U.S. Provisional Patent Application Ser. No. 61/772,623, which was filed on Mar. 5, 2013, by John T. Apostolos for a WIDEBAND SCANNING ANTENNA REFINEMENTS USING DIELECTRIC WAVEGUIDES WITH CONFIGURABLE GAPS and is hereby incorporated by reference. It also relates generally to U.S. patent application Ser. No. 13/372,117 filed Feb. 13, 2012, which is also incorporated by reference herein.

BACKGROUND

Technical Field

This patent relates to series-fed phased array antennas and in particular to a coupler disposed between the radiating antenna elements of the array and a waveguide having an adjustable wave propagation constant.

Background Art

Phased array antennas have many applications in radio broadcast, military, space, radar, sonar, weather satellite, optical and other communication systems. A phased array is an array of radiating elements where the relative phases of respective signals feeding the elements may be varied. As a result, the radiation pattern of the array can be reinforced in a desired direction and suppressed in undesired directions. The relative amplitudes of the signals radiated by the individual elements, through constructive and destructive interference effects, determines the effective radiation pattern. A phased array may be designed to point continuously in a fixed direction, or to scan rapidly in azimuth or elevation.

There are several different ways to feed the elements of a phased array. In a series-fed arrangement, the radiating elements are placed in series, progressively farther and farther away from a feed point. Series-fed arrays are thus simpler to construct than parallel arrays. On the other hand, parallel arrays typically require one feed for each element and a power dividing/combining arrangement.

However, series fed arrays are typically frequency sensitive therefore leading to bandwidth constraints. This is because when the operational frequency is changed, the phase between the radiating elements changes proportionally to the length of the feedline section. As a result the beam in a standard series-fed array tilts in a nonlinear manner.

SUMMARY

As will be understood from the discussion of particular embodiments that follows, we have realized that a series fed antenna array may utilize a number of coupling elements, typically with one coupler per radiating element of the array. The coupling elements extract a portion of the transmission power for each radiator from one or more waveguides. Controlled phase shifters may also be placed at each coupler. The phase shifters delay the amount of transmission power to each one of the respective phased array elements. The transmission line may also be terminated with a dummy load at the end opposite the feed to avoid reflections.

This arrangement is inherently frequency sensitive, since when the frequency is changed, so too is the phase at the respective radiating elements also changed. This change in phase is proportional to the length of its respective feedline section. While this effect can be used to advantage in frequency scanning, it is normally undesirable, since a phase controller must then also determine a change in the phase shift for each respective frequency change.

In one implementation, this shortcoming is avoided by using a waveguide having a variable wave propagation constant as the feed. In one example of a circularly polarized array implemented with such a waveguide, a single line of dual polarization couplers, or a pair of waveguides are used. Coupling between the variable dielectric waveguide and the antenna elements can be individually controlled providing accurate phasing of each element while keeping the Standing Wave Ratio (SWR) relatively low.

In still other aspects, multiple radiation modes may be used to extend a field of regard. Each of the radiation modes may be optimized for operation within a certain range of frequencies.

In still other arrangements, both to increase the instantaneous available bandwidth of the array and to allow maintaining direction of the main beam independent of frequency, progressive delay elements can be embedded in the waveguide couplers. In this arrangement coupler walls are placed along the variable dielectric waveguide. The coupler walls may be curved. These curved walls form focusing dielectric mirrors. These cause the energy entering the coupler to travel back and forth between the mirrors, accumulating delay, and thus effecting a further phase shift.

In one embodiment, the propagation constant of the waveguide is provided by adjusting an air gap between layers in the waveguide. There, the waveguide is generally configured as an elongated slab with a top surface, a bottom surface, a feed end, and a load end. The waveguide may be formed from dielectric material layers such as silicon nitride, silicon dioxide, magnesium fluoride, titanium dioxide or other materials suitable for propagation at the desired frequency of operation. Adjacent layers may be formed of materials with different dielectric constants.

Gaps are formed between the layers with a control element also provided to adjust a size of the gaps. The control element may be, for example, a piezoelectric, electroactive material or a mechanical position control. Such gaps may further be used to control the beamwidth and direction of the array.

In one refinement, delay elements for a number of feed points are positioned along the waveguide and fed with progressive delay elements. The delay elements may be embedded into or on the waveguide.

In another refinement, plated-through holes are formed along the waveguide orthogonal to the reconfigurable gap structure. Pins positioned in the plated-through holes allow the gap structure to mechanically slide up and down as the actuator gap changes size.

In yet another refinement, a 2-D circular or a rectangular travelling wave array is fed by waveguide(s) with multiple layers and actuator controlled gaps to provide high gain, hemispherical coverage.

BRIEF DESCRIPTION OF THE DRAWINGS

The description below refers to the accompanying drawings, of which.

DETAILED DESCRIPTION OF AN EMBODIMENT

1. Introduction

Figure 1:
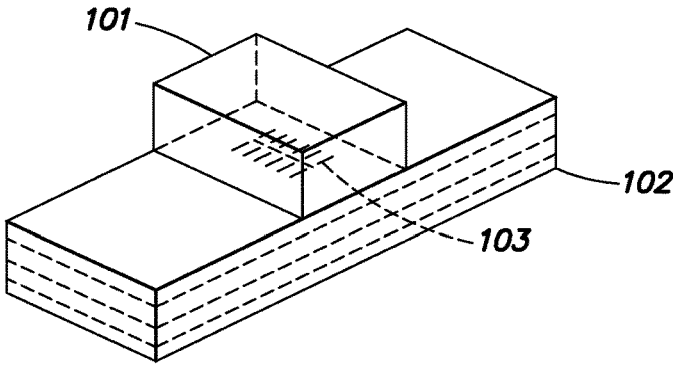
FIG. 1 is a isometric view of a unit cell used with a waveguide coupler.

In a microwave phased array antenna, it is desirable to simplify the design and manufacture of the power dividing phase network. In such components, individual phase controlling elements are placed between each radiating element in series. In this series fed configuration, a transmission line (which may be a waveguide or any other Transverse Electromagnetic Mode (TEM) line) contains all of the antenna element tap points which control power division and sidelobe levels, as well as the phase shifters which control the scan angle of the array. This arrangement provides a savings in the needed electronic circuitry as compared to a parallel feed structure which would typically require many more two-way power dividers to implement the same function.

By way of introduction, this simplification can be provided by performing the phase shift function by varying the wave propagation velocity of the transmission line, thereby inducing a change in electrical length between the elements. The resulting electrical length is given by $$\Delta\Phi=\beta L, \text{for } \beta=2\pi f/v$$

where L is the length of the transmission line between elements, and β is the wave propagation constant, inversely proportional to wave velocity, v. Wave velocity is conveniently controlled in certain types of waveguides by varying the dielectric constant of the material which in turn directly affects C', the capacitance per unit length of the transmission through the relationship $$v=1/\sqrt{L'C'}$$

with L' being the inductance per unit length. This arrangement however has the effect of changing the characteristic impedance of the line which equals $$Z_0=\sqrt{L'C'}$$

The characteristic impedance of the transmission line is thus a fundamental parameter of the implementation, affecting power distribution, efficiency, input Voltage Standing Wave Ration (VSWR) and the like. The fact that line impedance and velocity are coupled in this way is typically considered a fundamental limitation of the series fed array. Thus, scan angle and power bandwidth are coupled together; two parameters that are normally independent in other antenna systems.

However if the variable waveguide/transmission line appears are a reflection type function, the desired phase shift may still be achieved using the same fundamental type of C' variation. In this case, reflections due to the characteristic impedance mismatch of the variable line are canceled at the input, as long as the two transmission line segments (of βL) are equal. This arrangement occurs in many microwave circuits called "quadrature coupled" circuits. In this case, the approach is to provide a variable transmission line, with quadrature coupling to the radiating elements.

2. Waveguide Coupler/Coaxial Holes to L-Probe-Fed-in-Quadrature Patch

In one implementation, a quadrature coupler uses coaxial holes and an L-shaped probe to feed each radiating antenna element in a linear array. This arrangement solves the problem of how to control the coupling between the variable dielectric waveguide and the antenna elements to achieve accurate weighting of the antenna elements, while still keeping the Voltage Standing Wave Ratio (VSWR) low enough to eliminate the photonic band gap null for broad side angles.

One embodiment of such a waveguide coupler 101, shown in FIG. 1, is coupled to a variable dielectric waveguide 102 below it via several slots 103 formed in the broad walls of the main variable dielectric waveguide 102 and the coupler 101. The slots 103 may be provided in various orientations, numbers and sizes which control the coupling level into and/or out of the coupled waveguide.

FIG. 1 illustrates a unit waveguide coupler 101; each element of a multi-element array requires one such unit coupler. In such an arrangement, as will be described below, the unit waveguide couplers 101 are periodically spaced along a main axis of the waveguide 102 according to the desired radiating element spacing on the top layer.

In one embodiment, the unit waveguide coupler 101 is formed in a Printed Circuit Board (PCB) with walls defined by vias or metal plates, but the unit coupler 101 can also be formed in a traditional waveguide structure. The waveguide coupler 101 need only be relatively short in length, as it is used to transfer a guided mode from the main waveguide structure 102, up to the radiating element.

The main waveguide(s) 102 are formed from a dielectric material or mechanical configuration for which the propagation constant can be varied, either by using materials where dielectric constant is changed via a bias voltage, or through mechanical layer separation in multilayer waveguides. See the discussion below, as well as our related U.S. patent Ser. No. 13/372,117 filed Feb. 13, 2012 for more details of adjustable waveguide structures.

Figure 2:
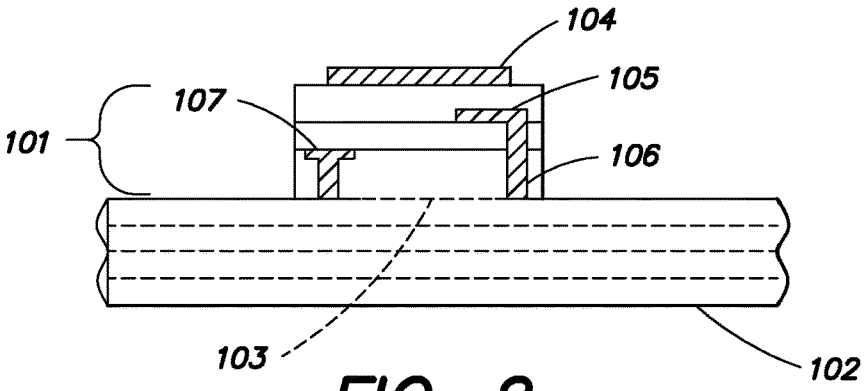
FIG. 2 is a side view of the unit cell.

FIG. 2 shows a side view of the unit cell 101 geometry. On one end of the coupler (the end which feeds a patch antenna radiating element 104) there is a shorted pin 106 (via) that passes through a coaxial hole in the top of the waveguide, up through substrate layers and lands on an L-shaped probe 105 under the patch element 104. On the other side of the coupler 101 is another pin, serving as a matched load 107. Because the coupler 101 is directional, very little energy is dissipated in the matched load 107.

Above the L-probe 105 sits another substrate 108 and on top of that the patch radiator element 104. The L-probe 105 is capacitively coupled to the patch radiator 104. The shunt capacitance between the L-probe and ground plane is cancelled with the series inductance provided by the load pin 107.

Figure 3:
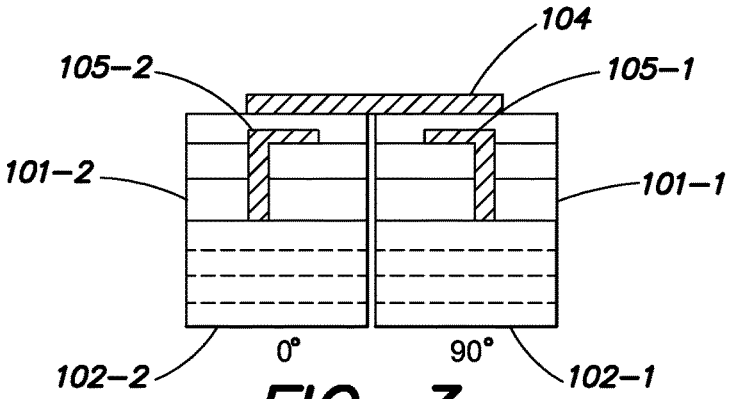
FIG. 3 is a cross-section end view of the unit cell in an embodiment using a pair of variable dielectric waveguides.
Figure 10:
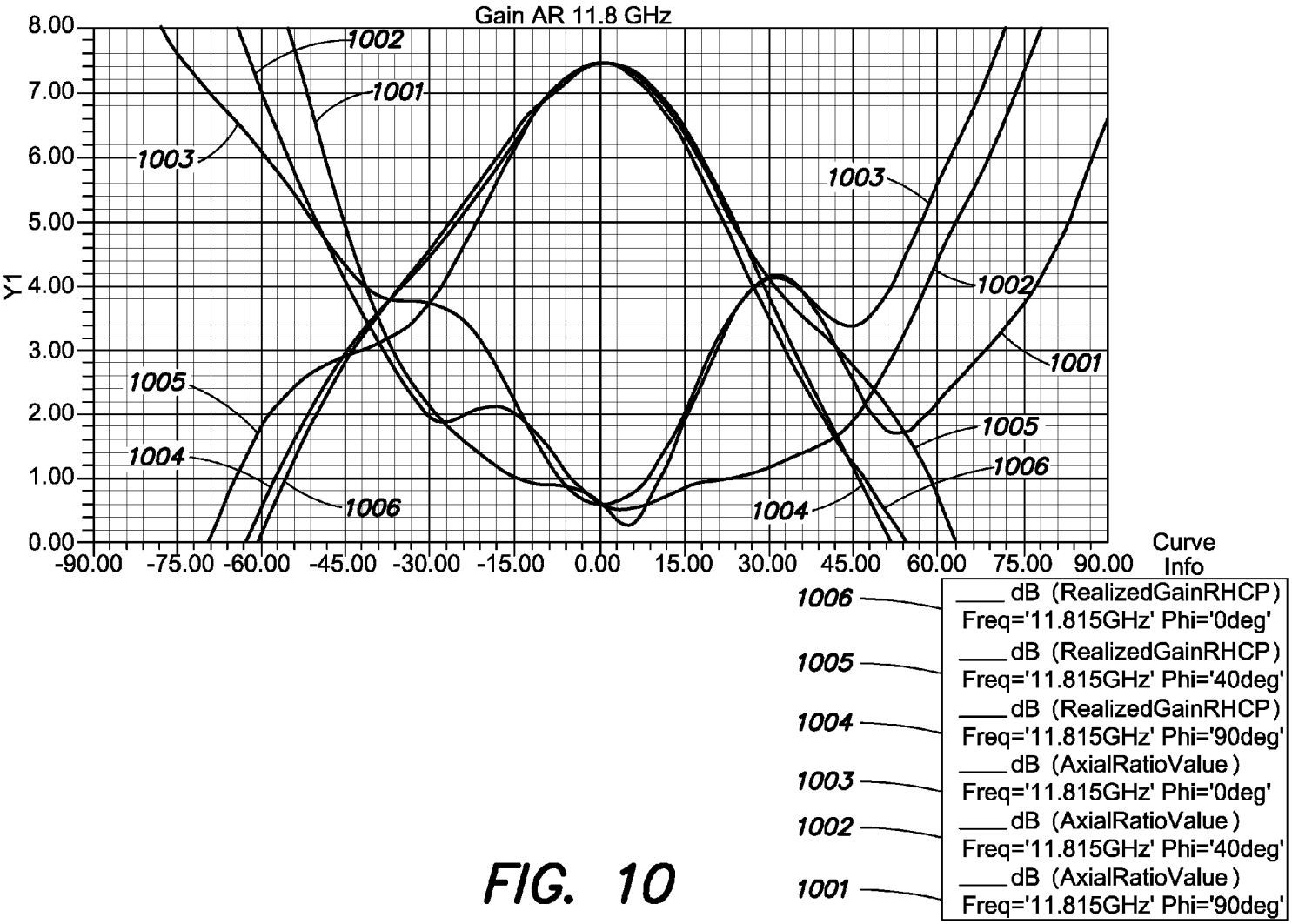
FIG. 10 is an expected gain pattern.

FIG. 3 shows further details of the geometry of the feed for an embodiment with two waveguides 102-1, 102-2 arranged in parallel. When two respective L-probes 105-1, 105-2, waveguide couplers 101-1, 101-2, and main variable dielectric waveguides 102-1, 102-2 are situated with a single radiating patch 104 (as per FIGS. 3 and 4), each radiating patch radiates a very wide, highly efficient antenna pattern as shown in FIG. 10. Any polarization can be achieved by controlling the phase shift and amplitude for the inputs to the two variable dielectric waveguides.

3. Quadrature Dielectric Traveling Wave Antenna Feeds

In one implementation, phase shift between two feeds changes along with change in a variable dielectric used to implant the main waveguide(s) 102.

Traditionally, to feed a dielectric traveling wave antenna, scatterers or couplers fed in series along the length of a waveguide. For a fixed propagation constant in that waveguide, this fixes the phase difference between the scatterers or couplers, which in turn radiate or couple energy onto another transmission line with that fixed phase difference. In a fixed beam circular polarization traveling wave antenna, this means two quadrature scatterers or couplers are spaced at $\lambda/4$ (where $\lambda$ is the propagation frequency). This causes the phase shift between the two polarizations to be orthogonal, or 90 degrees apart.

However, when the propagation constant of a waveguide 102 can be varied, such as in the case of a dielectric traveling wave antenna described herein, this phase shift between the scatterers or couplers 101 varies with the imaginary component of gamma (and velocity of propagation). The impact of this variable phase shift causes the axial ratio of a Circularly Polarized (CP) antenna to degrade because the axial ratio has a term for phase difference in it. Typically, one would space the scatterers or couplers at such a spacing to cause the phase shift to be 90 degrees as the beam is crossing through broadside so 1) axial ratio would be optimum at broadside and 2) the photonic band gap reflection is cancelled within the waveguide.

Figure 4:
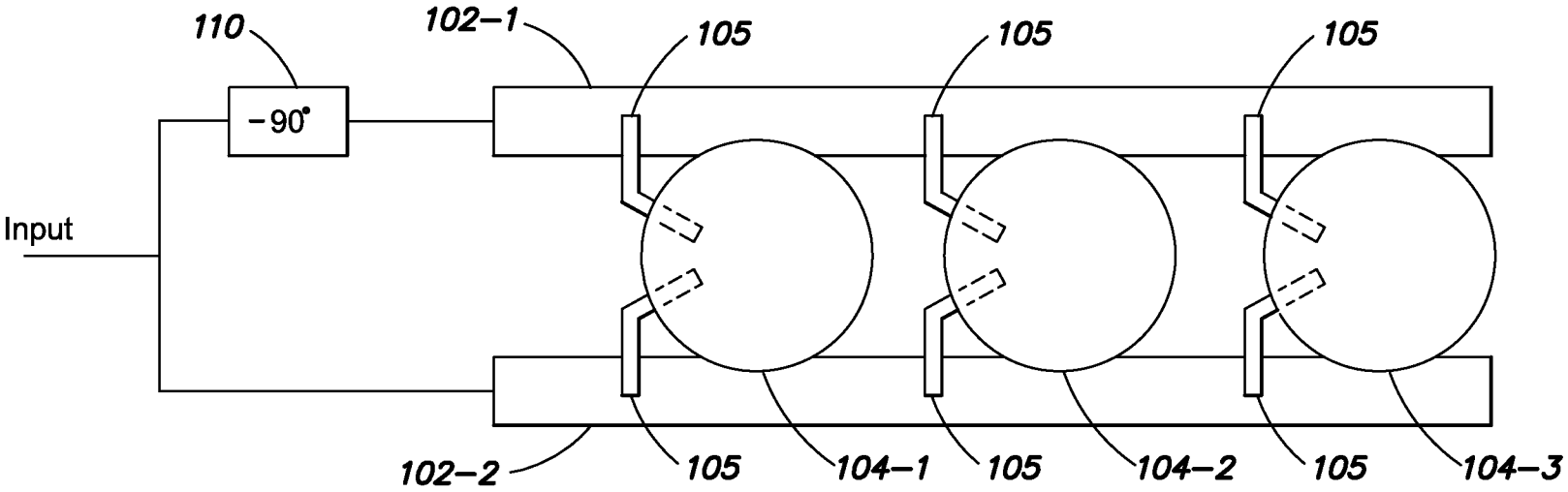
FIG. 4 is a top view of an embodiment using a pair of waveguides with a constant phase shift provided by using dual quadrature couplers for each element.

An alternative to suffering this axial ratio degradation is to feed a quadrature radiating element (one example would be a dual input patch), as pictured in FIG. 4. FIG. 4 shows the two waveguides 102-1, 102-2 having a relative constant phase shift 110 placed before the feed. In the CP antenna example, this would be a constant phase shift of 90 degrees leading into one of the waveguides. In this way, the phase shift between pairs of scatterers or couplers 101 is fixed, and the change in propagation constant in the waveguide does not affect this phase shift (only the L-probes 105 are shown in FIG. 5 for the sake of clarity; it is understood that unit couplers 101 are associated with each radiating element 104 in this embodiment as were shown in FIG. 3).

Figure 5:
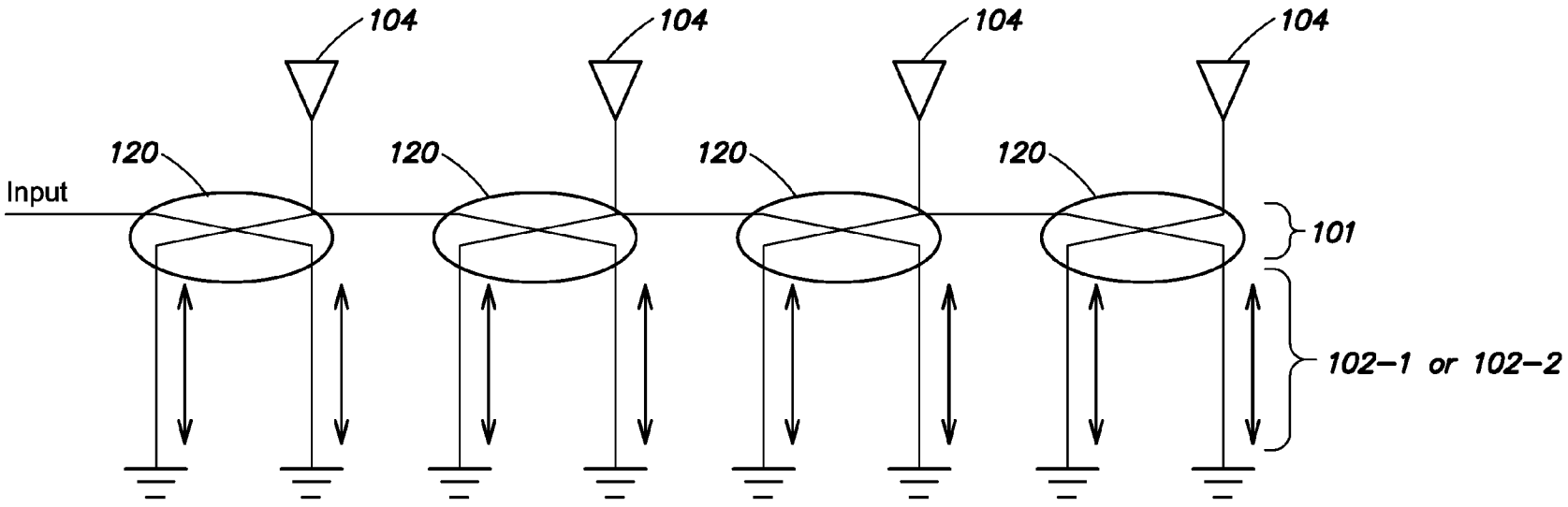
FIG. 5 is a embodiment using a single waveguide, with couplers for each array element; the couplers include matched reflection phase shifters as may be implemented with a quadrature hybrid.

The two waveguides 102-2, 102-2 can feed a single line of dual polarization, dual input radiators as per FIG. 4, or each waveguide can feed an individual line of single polarization radiators, as per FIG. 5.

4. Reflectionless Angle Scanning Series Fed Array

This implementation solves an impedance mismatch when changing transmission line velocity.

As per FIG. 5, this implementation a) inserts an impedance transformer between each radiating element of the array and the following device; and 2) places two equivalent variable transmission lines on quadrature hybrid ports and using combined reflected waves at a fourth port as output.

The arrangement is motivated by the following factors: (a) High Voltage Staning Wave Ratio (VSWR) on travelling wave antennas scanned near boresight due to admittances adding up when elements separated by half wavelength ($\lambda/2$); (b) characteristic impedance of series feeding transmission line changing as its velocity is changed to steer the array.

Prior approaches had several disadvantages including:

(a) VSWR buildup when antenna elements are separated by half wavelength. It is well known that impedance on a line repeats every half wavelength, effectively putting the elements in parallel. When N such impedances are placed in parallel, a high VSWR results.

(b) Characteristic impedance (Zo) of feed line changes as its velocity (vp) is changed to steer the beam. Zo and vp are interrelated by Zo=sqrt(L'/C') and Vp=1/sqrt (L'*C'). It is impossible to change C' without changing both Zo and vp.

The advantage of the FIG. 5 approach is that the addition of impedance transformer eliminates VSWR buildup; in addition, the reflectionless phase shifter decouples Zo and Vp.

As a result, the lowered VSWR will increase gain and improve system performance; and decoupled Vp and Zo will improve maximum scan angles for a given change in feedline parameter C'.

More particularly, by inserting matched reflection type phase shifter(s) 120 into the line (see FIG. 5) there is no variation in feedline Zo as the electrical lengths of the short circuited variable lines is changed.

Additionally, the impedance at the junction of each antenna element and the rest of the array can be made to equal 50 ohms by making the parallel combination of the element and feedline impedance 50 ohms. This is done by increasing the feedline impedance by using a quarter wave transformer, or other methods.

Figure 6:
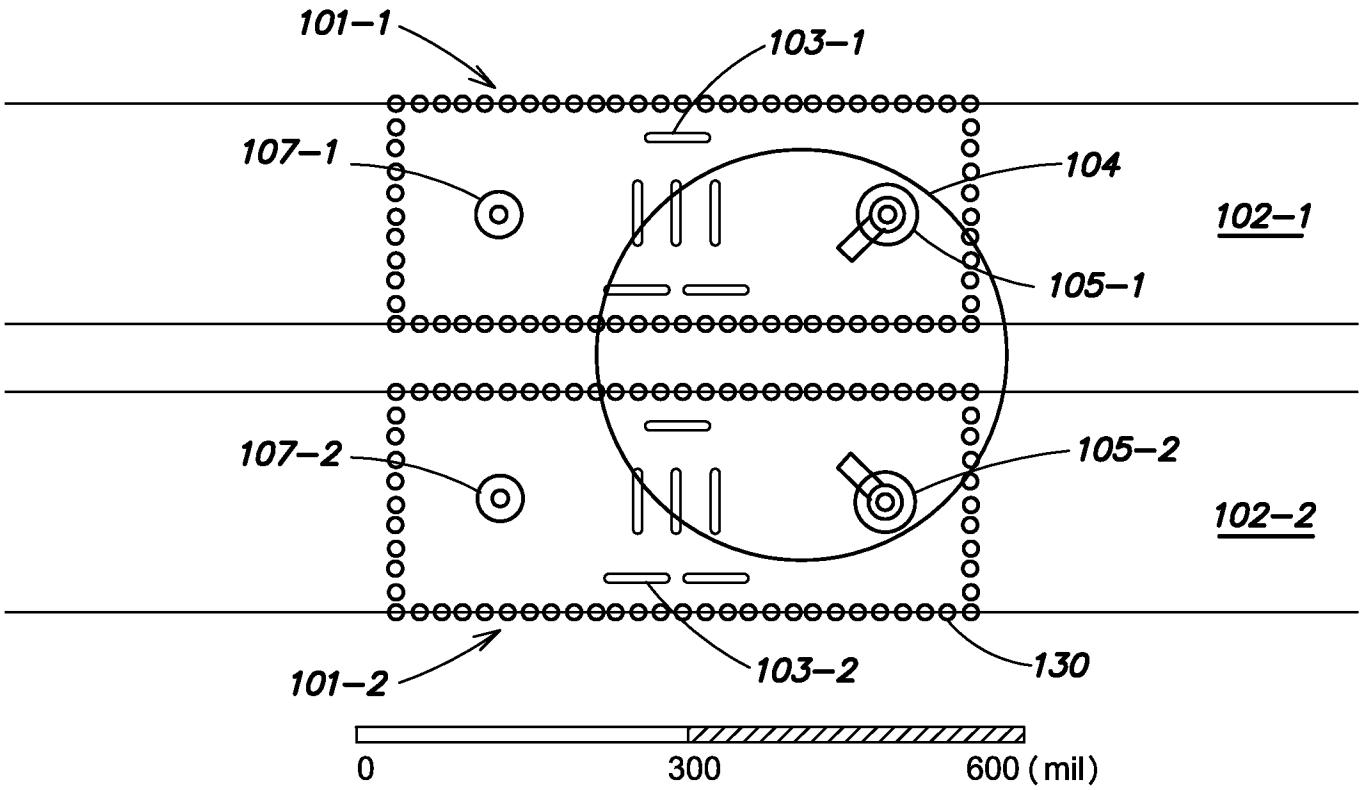
FIG. 6 is a more detailed top view of one cell of the embodiment of FIG. 4.

FIG. 6 is a top cutaway view of one implementation of the two waveguide array shown in FIG. 4. FIG. 6 shows the detail for one unit cell from a top view. A circular radiating element is implemented as a patch antenna 104. Two waveguide couplers 101-1, 101-2 feed the patch element 104 in quadrature. The walls defining each of the unit waveguide couplers 101 are implemented with a "picket fence" of via pins 130 disposed, as shown, in a rectangular region about the unit cell. Also visible are the L-probes 105-1, 105-2, load pins 107-, 107-2, and coupling slots 103-1, 103-2.

Figure 7:
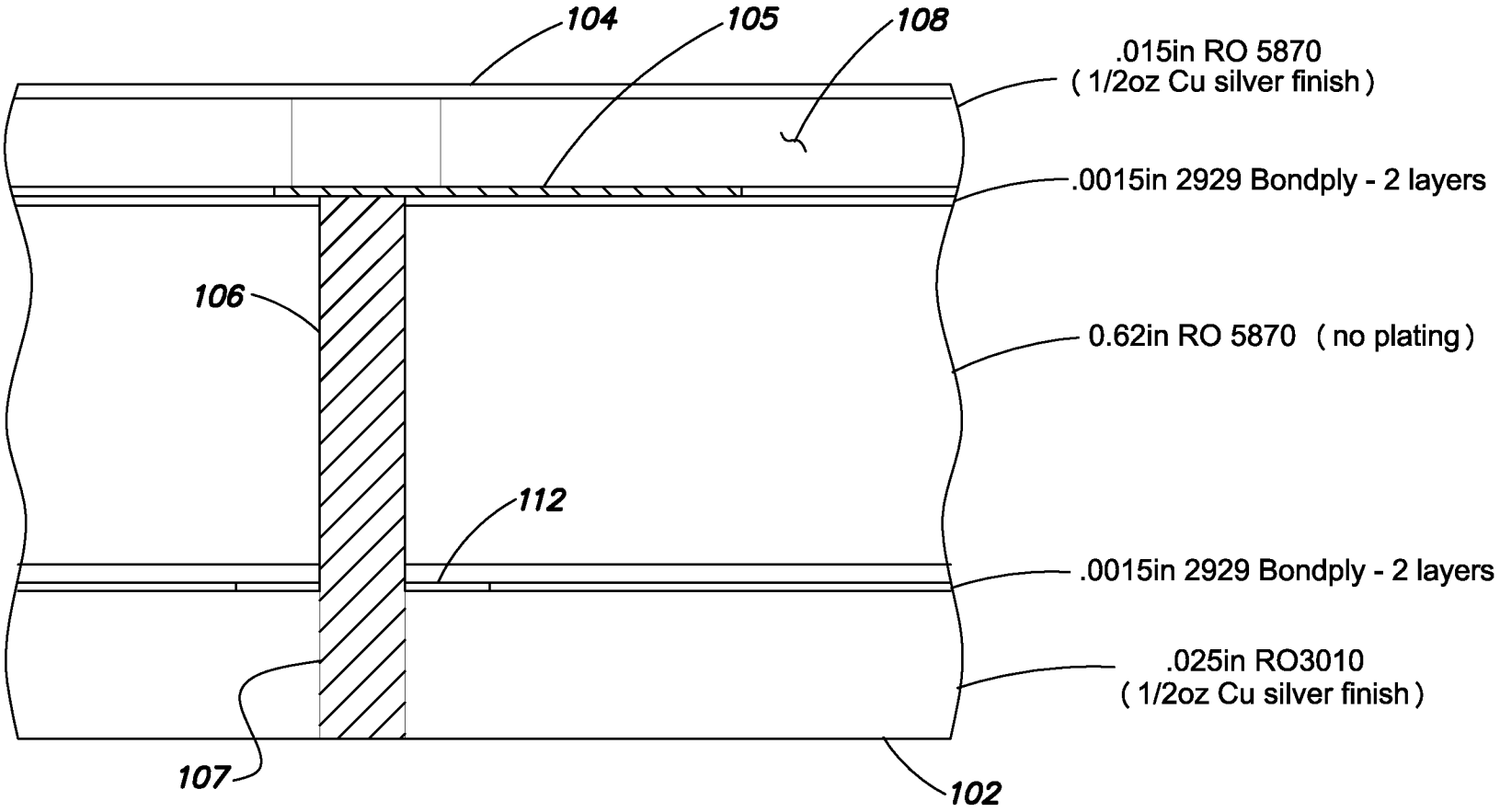
FIG. 7 is a cross-sectional view of the unit cell for that same embodiment of FIG. 4.

FIG. 7 is a more detailed cross-sectional side view of the unit cell 101 showing the radiating patch, L-shaped probe 105, coaxial holes 112 that accommodate L-shaped probe 105, shorting pin 107, and section of the coupled waveguide 102. Example dimensions and materials are also listed in FIG. 7 (in this view the vertical axes of the L-shaped probe 105 and shorting pin 107 are seen aligned with one another).

Figure 8:
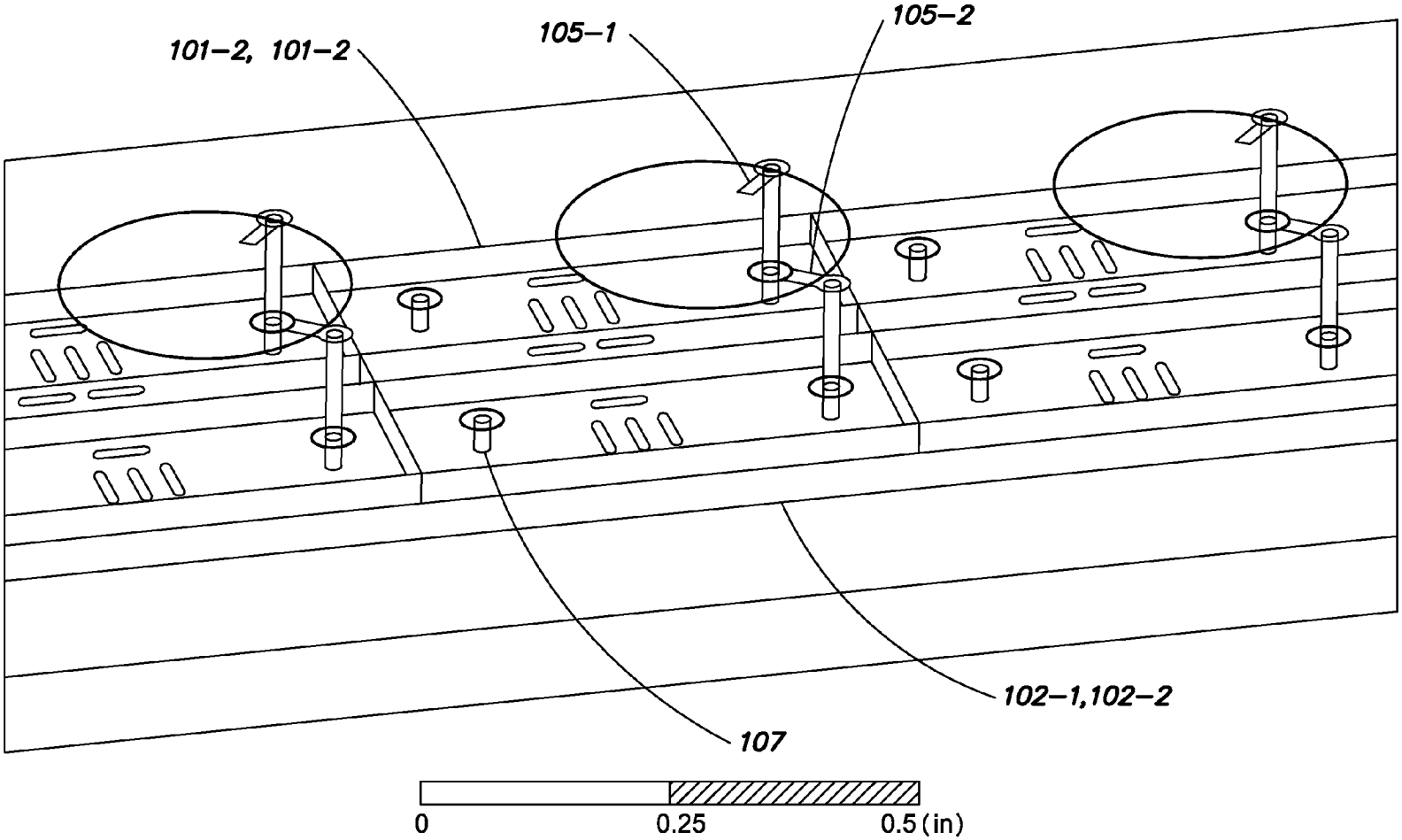
FIG. 8 is a isometric, partial cutaway view showing detail of the coupled waveguide walls formed as plates.
Figure 9:
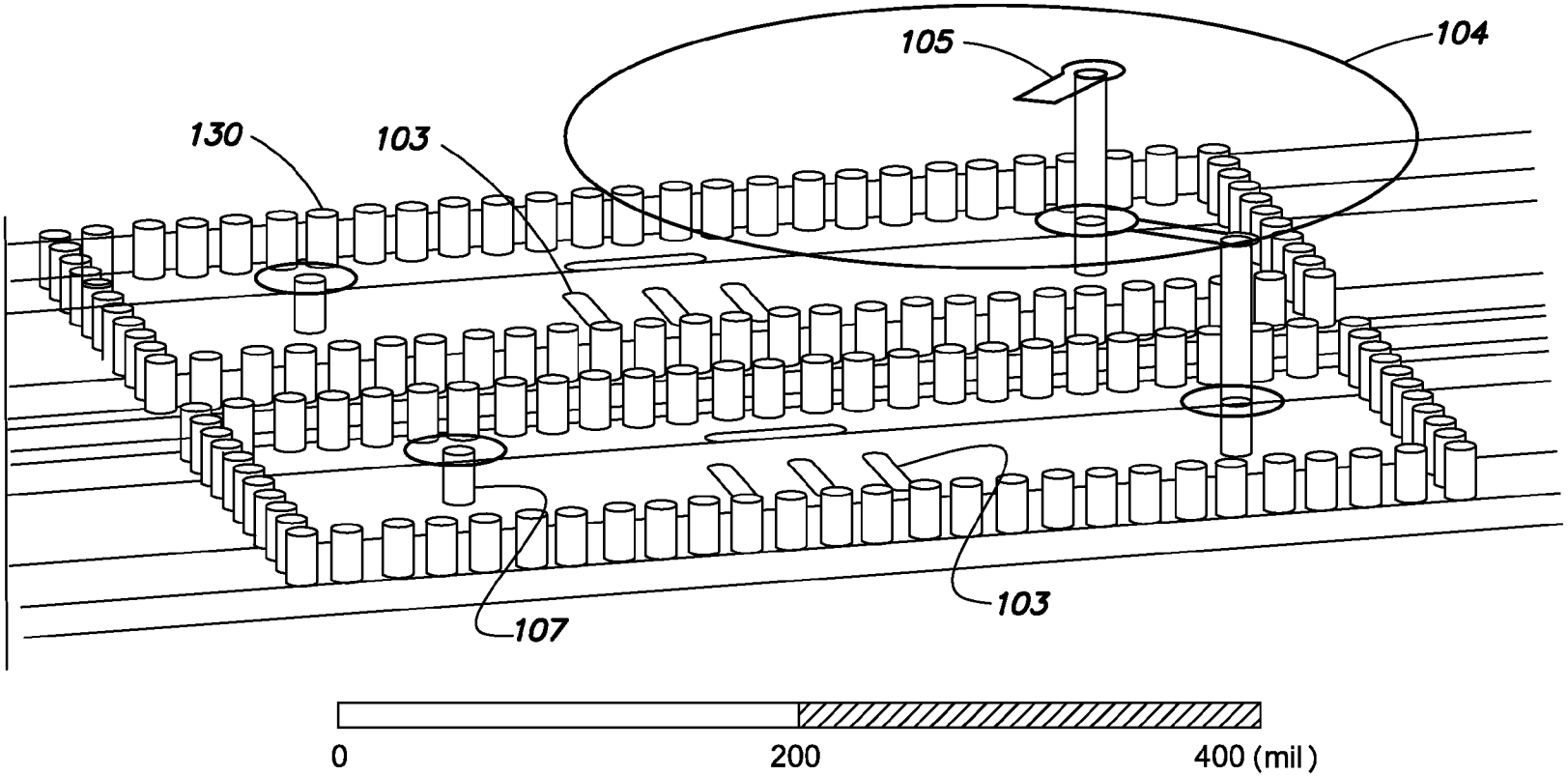
FIG. 9 is another isometric view of the same embodiment with the walls implemented using pins.

FIGS. 8 and 9 are further isometric views of a two waveguide embodiment showing the several radiating patches and unit couplers. FIG. 8 uses metal plates to define the unit cell walls; the FIG. 9 arrangement instead uses pins to accomplish the same end.

5. Multiple Radiation Modes to Extend Field of Regard in a Traveling Wave Antenna.

The following equation shows the peak radiation scan angle for any traveling wave antenna:

$$\cos\theta = \frac{\beta}{\beta_o} - \frac{\lambda}{S}m$$

where:

θ is the scan angle

λ is the free space wavelength

S is the line array element spacing $\beta_o$ is the free space propagation constant β is the adjustable waveguide propagation constant; and m is the radiation mode One can thus select multiple m (mode values) and find multiple solutions for theta for a certain range of β. For example, in the plot of FIG. 11, the x axis represents theta (scan angle), and the y-axis represents an "effective dielectric constant" which is related to beta. A solution to the equation is shown for three frequencies (at the operating frequency band edges and at a middle frequency) for an element spacing of 0.525λ. As we change beta (the waveguide propagation constant), the solution to the equation scans along theta.

Figure 11:
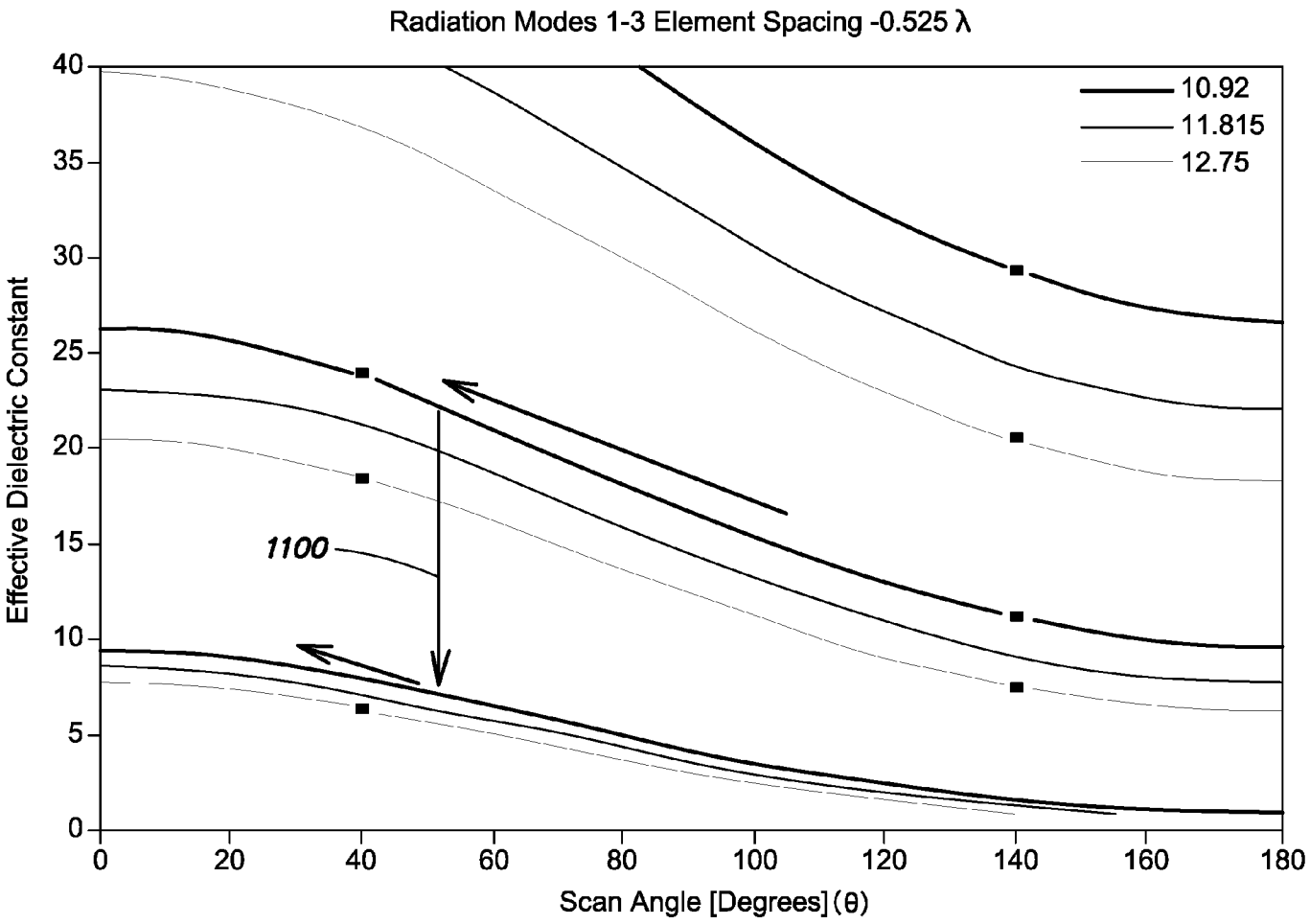
FIG. 11 shows effective dielectric constant versus scan angle for three radiation modes.

There are three radiation modes plotted (m=0, 1, 2) in FIG. 11. It can easily be seen that to scan to a single theta value (such as theta indicated by the vertical arrow 1100), one could source the traveling wave antenna radiation from a waveguide with an effective dielectric constant of different values, and depending on that value, a certain mode would be selected. In the illustrated case, one could scan lower in theta along the thick line 1100 using up to an effective dielectric constant of 22.5, and if desired, continue scanning with a lower dielectric constant of 7.5. Using this method of mode switching, the FoR can be extended to 180 degrees.

This feature becomes useful when trying to achieve very high effective dielectric constants, where the gaps between waveguide laters must become very small. To alleviate this very small gap requirement, as the array is scanned in that direction, operation can switch to the next lowest mode to continue to the Field of Regard (FoR) edge with larger airgaps.

Figure 12:
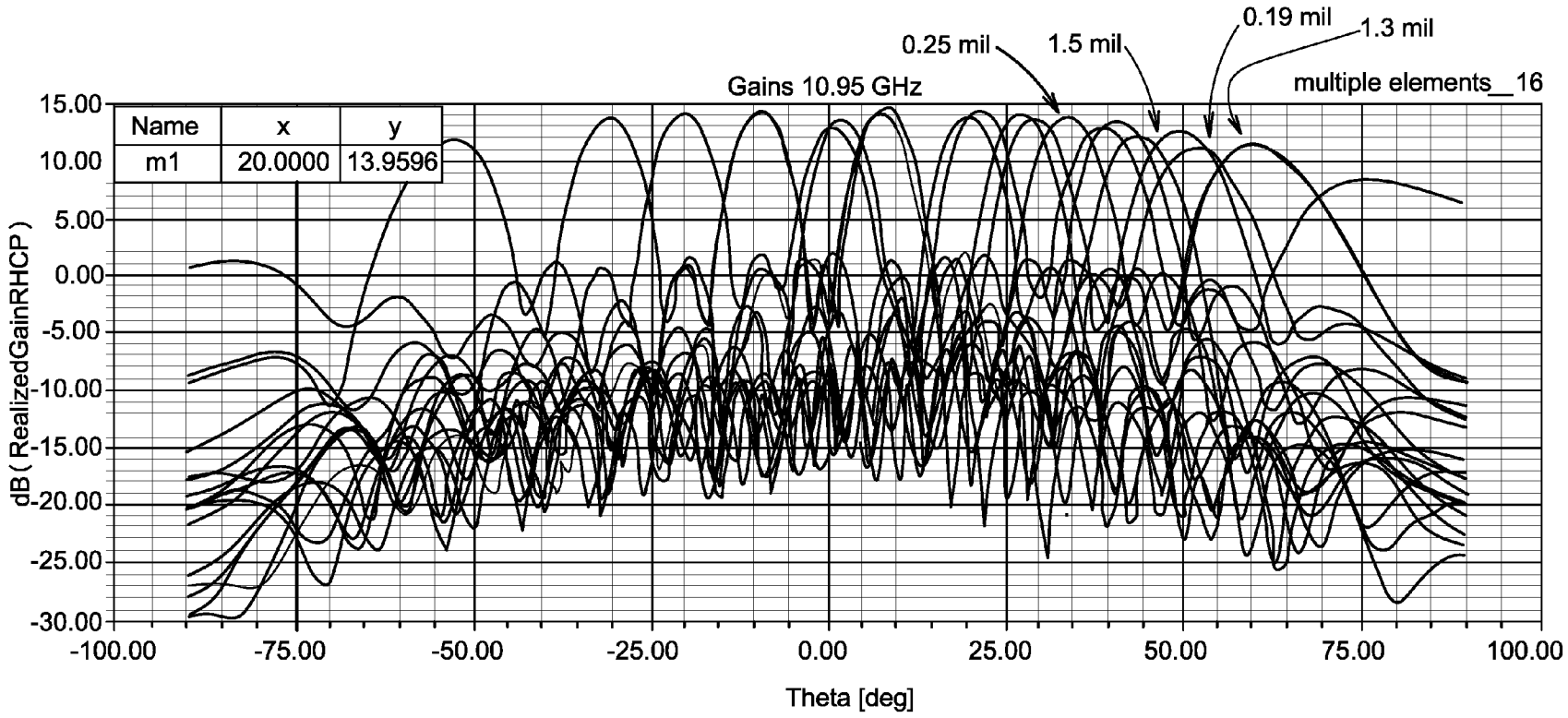
FIG. 12 illustrates gain versus angle when multiple radiation modes are employed to extend a field of regard.

An HFSS (High Frequency Structured Simulator) model simulated this phenomenon and shows that multiple radiation modes can be used to extend the Field of Regard (FoR). See FIG. 12.

6. Progressive Delay Elements

Figure 13:
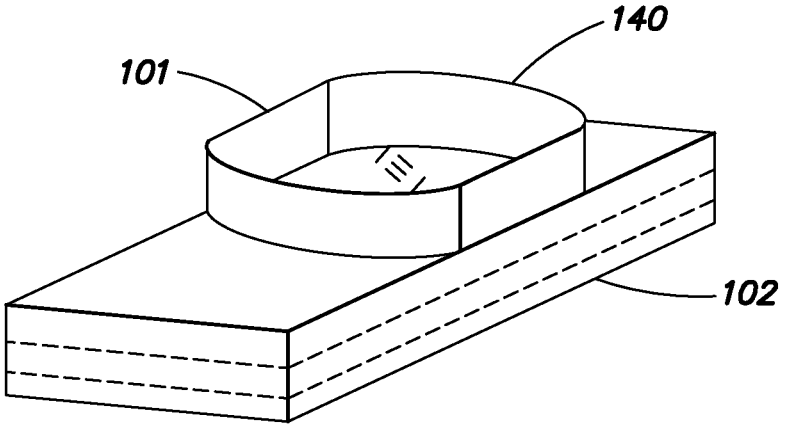
FIGS. 13 and 14 are an isometric and cutaway side view of an implementation using curved walls disposed perpendicular to the propagation axis of the waveguide.
Figure 14:
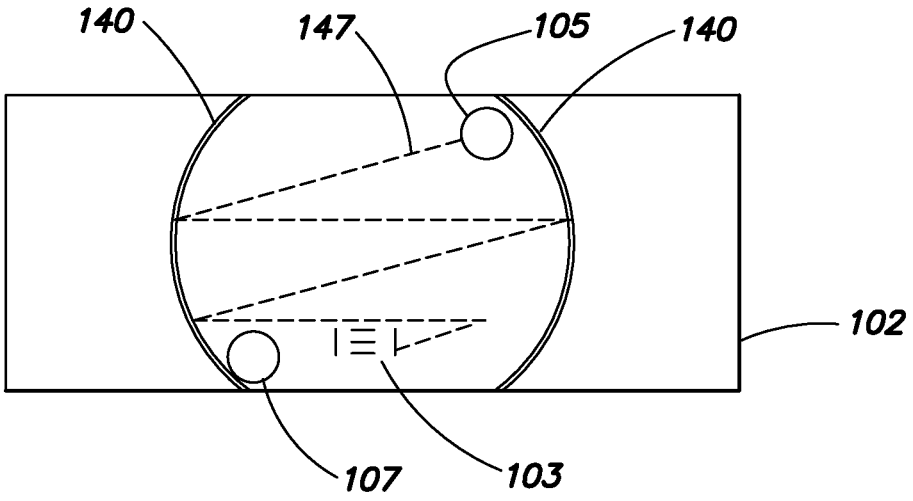

To increase the instantaneous bandwidth of the array, i.e. to maintain the direction of the main beam independent of frequency, progressive delay elements may be embedded in or with the waveguide couplers 101. One possible geometry is shown in FIGS. 13 and 14. The input and output coupler faces 140 lying transverse to the axis of the variable dielectric waveguide 101 may be curved to form a pair of focusing dielectric mirrors 145. The energy entering the coupler 101 then travels back and forth (as shown by dashed lines 147) between the mirrors 145 much like the mirrors in a laser. The number of passes will depend upon the exact curvature of the mirrors 145. It is anticipated that a high dielectric material (e=36) may be used to accumulate the required delay. Delay will thus vary progressively along the array.

7. Design Considerations

In addition, there are further possibilities with the phased array antenna(s) described herein Do not implement any delay or correction. Depending on bandwidth requirements and peak gain beamwidth, the far-field beam direction may only scan over a very small angle across the bandwidth. This beam scanning with frequency causes a slight distortion in the gain over frequency curve, and the severity of that distortion depends on the beamwidth. This method is acceptable up to a 2.5% bandwidth, given the beamwidth is not extremely narrow.

Progressive delays embedded in the line arrays. The progressive delay approach allows equalization of delays and far-field pattern alignment over a 10% bandwidth. A delay element can be inserted between the coupled waveguide and the radiating element. The delay element is designed N times for different delay values, and each one is implemented separately along the line array. The limiting factor in the progressive delay element approach is loss per unit delay. As with the waveguide, loss in the delay element must be kept to a minimum.

Dielectric wedge approach. A dielectric wedge may be placed atop the array, and integrated as part of the radome. The dielectric constant and shape of the wedge performs time delay beamforming for each progressive element. The advantage of the wedge is that it can be implemented in a low loss, high epsilon dielectric, providing a high delay to loss per unit length ratio. For this reason, it can achieve the highest relative bandwidth, >10%.

8. Waveguide with Adjustable Propagation Constant and Progressive Delays

Conventional traveling wave fed phased arrays are inherently narrow band antennas. The equation governing the beam direction θ is given by $$\cos(\theta)=\text{beta(waveguide)/beta(free space)}-m\lambda/d$$

where beta (waveguide) is the propagation constant of the waveguide, beta (freespace) is the propagation constant in air, d is the array spacing, m is the mode number, and λ is the wavelength. The wavelength term limits the bandwidth.

Figure 15A:
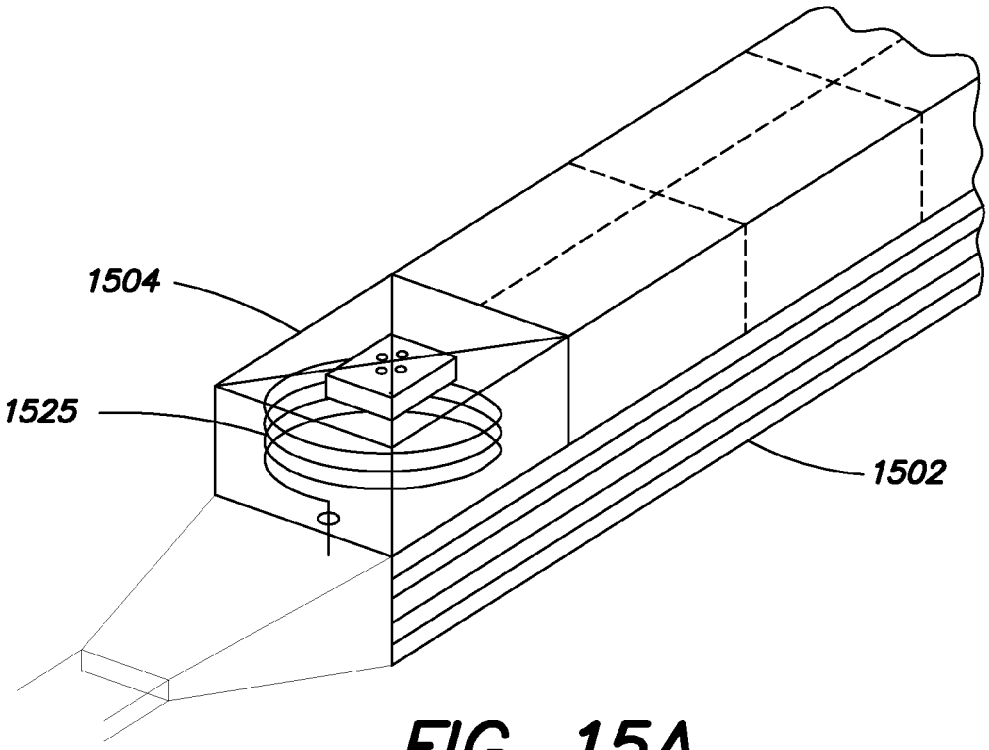
FIG. 15A illustrates a waveguide with variable effective propagation constant.
Figure 15B:
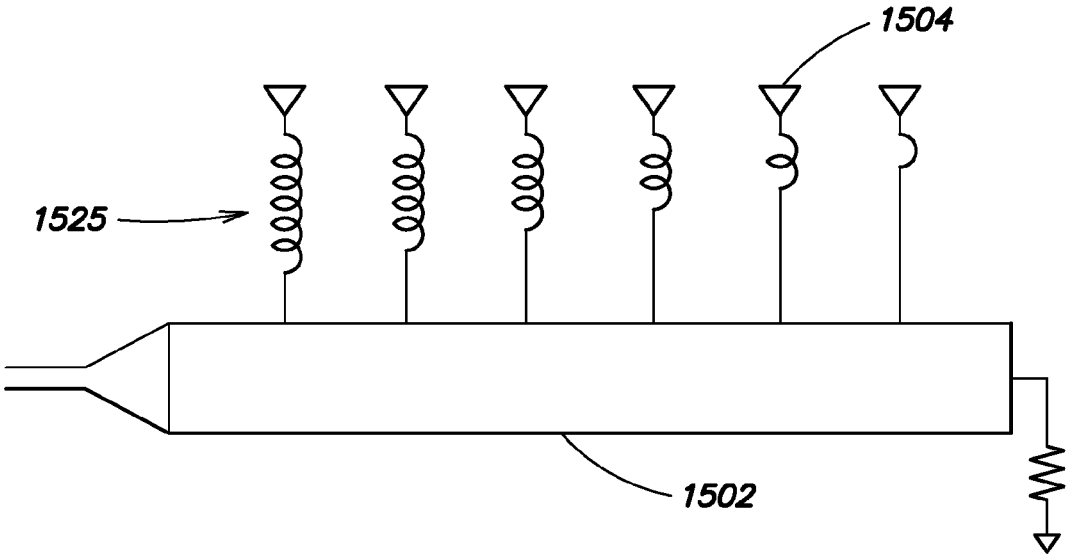
FIG. 15B illustrates an electrical connection diagram.

FIGS. 15A and 15B illustrate a refinement where the bandwidth limitations of travelling wave phased arrays are overcome by embedding progressive delays into array elements positioned on or in the waveguide. Here a variable propagation constant waveguide 1502 is formed of multiple layers, with gaps provided between the layers. Changing the size of the gaps has the effect of changing the effective propagation constant of the entire waveguide.

An array of antenna elements, here consisting of crossed bow ties 1504, are placed along the length of the top surface of the waveguide 1502. The antenna elements 1504 may each be fed with a quadrature hybrid combiner as for the other embodiments (not shown). The key to the wide band operation is a delay line 1525 embedded in or with each antenna element along the array. The delay line 1525 is a compact helical HE11 mode line using a high dielectric constant material such as titanium dioxide or barium tetratitanate.

As shown in FIG. 15B, the delays 1525 progressive decrease along the array. These delays cancel out the delays caused by the waveguide 1502 which allows the use of m=0 in equation (1) and results in the equation:

$$\cos(\theta)=\delta\ \text{beta(waveguide)/beta(freespace)}$$

where δ beta(waveguide) is the additional delay (plus or minus) added to the waveguide to permit scanning. There are no frequency dependent terms, thus the scanning is wideband.

The additional delay is provided by changing the propagation constant in the waveguide with a gap structure.

9. 2-D Dielectric Travelling Wave Array Methodology for Implementation of Actuator-Controlled Beam Steering In a second refinement, a waveguide has plated-through holes provided with a reconfigurable gap structure, with pins positioned in the plated-through holes. The pins allow the structure to slide up and down as the actuator gap changes size.

Figure 16:
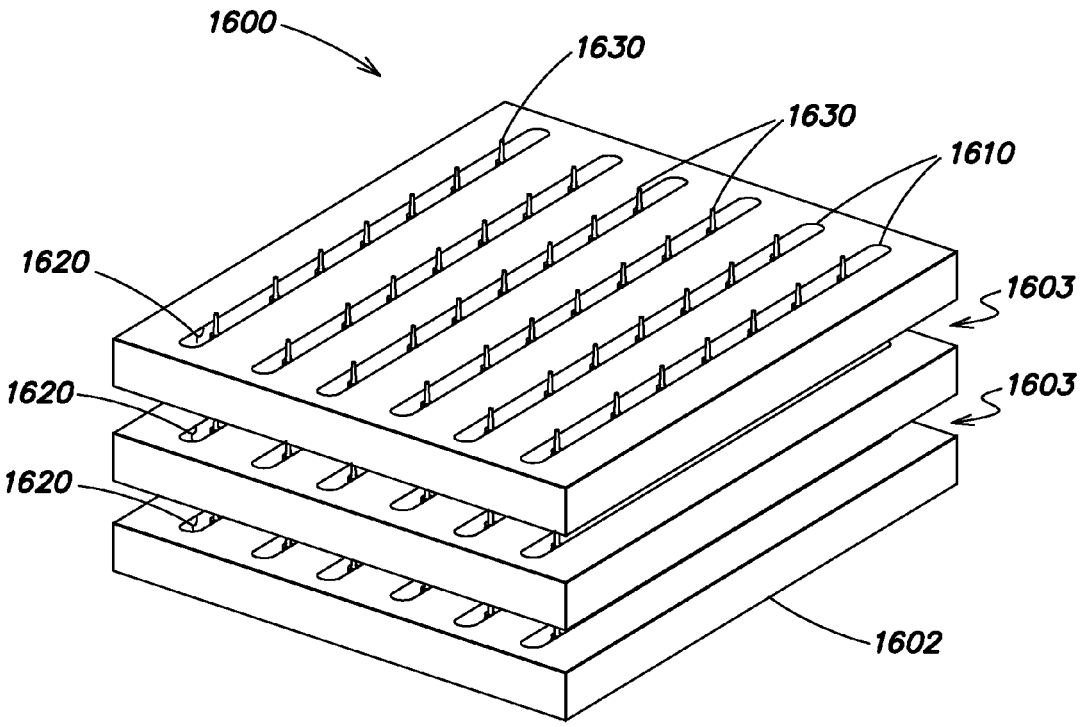
FIG. 16 is an exploded top view of a multilayer waveguide where waveguide sidewalls are defined using sliding pins with plated through holes.

In order to facilitate beam steering in two dimensions with a 2-D configuration consisting of rows of 1-D traveling wave excited arrays of elements, a 2-D gap structure may utilize layers of dielectric slabs 1602 with rows of periodically spaced plated through holes 1610 and actuator strips 1620 of piezoelectric or electro active material. The rows of plated through holes define side walls of individual waveguide sections 1502. The slab waveguide 1600 arrangement is shown in FIG. 16.

Pins 1630 are placed along the actuator strips to:

1) ensure the alignment of the reconfigurable gaps 1603 as the gap spacing is increased to scan the beam;

2) add shielding between adjacent rows of 1-D arrays;

3) provide a DC path for control power to the actuator strips 1620; and 4) feedback to provide close loop control.

Strips of conducting material can be deposited on both sides of the piezoelectric layers 1620 to enable control voltages to be impressed upon the piezoelectric actuators through the pins 1630. The control voltages can be applied separately to each row or applied to the entire array by connecting the conducing strips together at one end of the structure.

Figure 17:
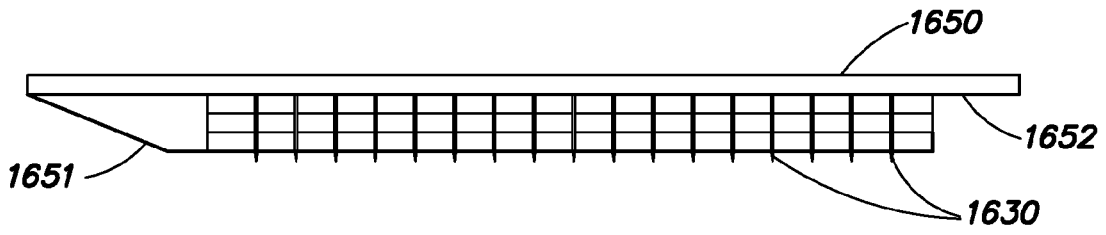
FIG. 17 is a side cross-sectional view of the FIG. 16 embodiment.

FIG. 17 shows a side view of the same structure 1600 with an exciting horn antenna (feed) 1650 at one end. There will typically an array of horns, one for each row (e.g., for each waveguide). To facilitate beam steering in the direction orthogonal to the 1-D rows of elements, each horn is fed with a progressive phase shift. The radiating patch(es) are placed in a layer 1650 above the slabs 1602.

Figure 18:
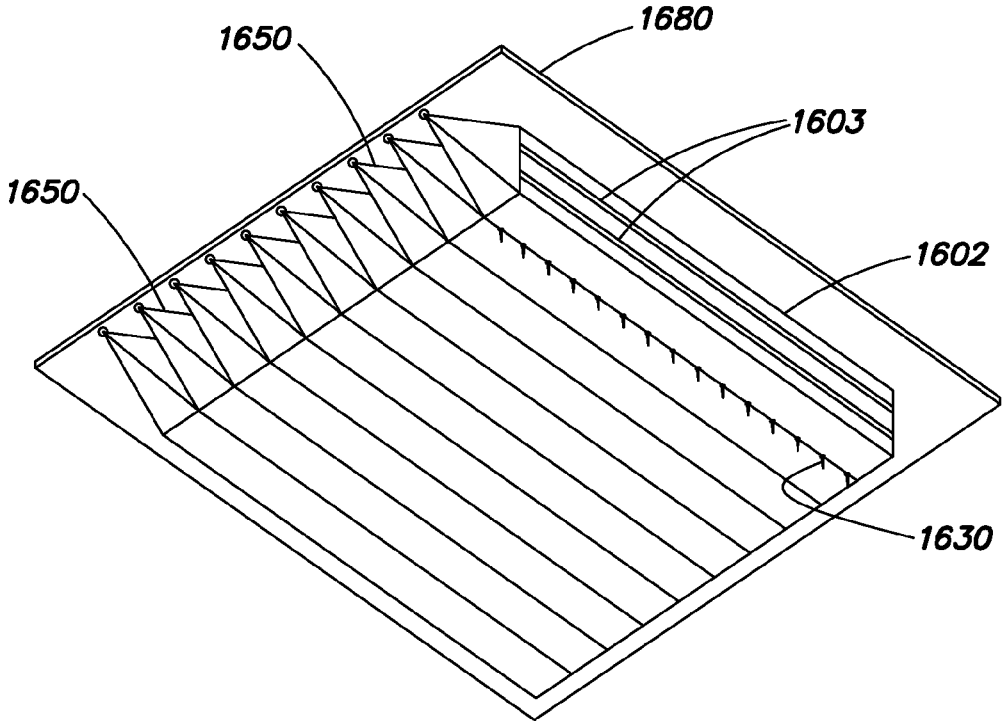
FIG. 18 is a bottom view of the same embodiment.

FIG. 18 shows a bottom view of the same slab waveguide structure 1603 with the array of horn antennas 1650 now visible at one end. The reconfigurable gaps 1603 and the waveguide pins 1630 are also seen. The lower surface may have a printed circuit board 1680 that provides control and power circuits to the actuators which allows for control of the gap size(s). The control of the gaps changes the effective dielectric of the slab which allows for scanning of the beam without a change of frequency in the traveling wave array.

10. 2-D Dielectric Travelling Wave Antennas

In this refinement, 2-D circular and rectangular travelling wave arrays are fed by slab waveguides with multiple layers and actuator controlled gaps to provide high gain hemispherical coverage.

Traveling wave arrays would typically require a separate waveguide to provide excitation to each row of a 2-D traveling wave array. Here, a single waveguide provides an elevation steerable line array of elements with the line arrays configured side-by-side. A separate conventional feed system is used to excite each line array with the proper phase or time delay to provide steerabiility in the azimuthal plane. The elevation steering of the traveling wave line arrays is accomplished by actuator controls gaps in the dielectric to control the propagation constant.

By using a two-dimensional slab waveguide with 2-D gaps controlled by actuators, it is possible to eliminate the need for separate waveguides and to provide high gain hemispherical coverage. The two geometries to be considered are (A) a Cartesian geometry using rectangular slabs and (B) a circularly symmetric geometry using circular slabs.

(A) Cartesian Geometry Case Using Rectangular Slabs

Figure 19A:
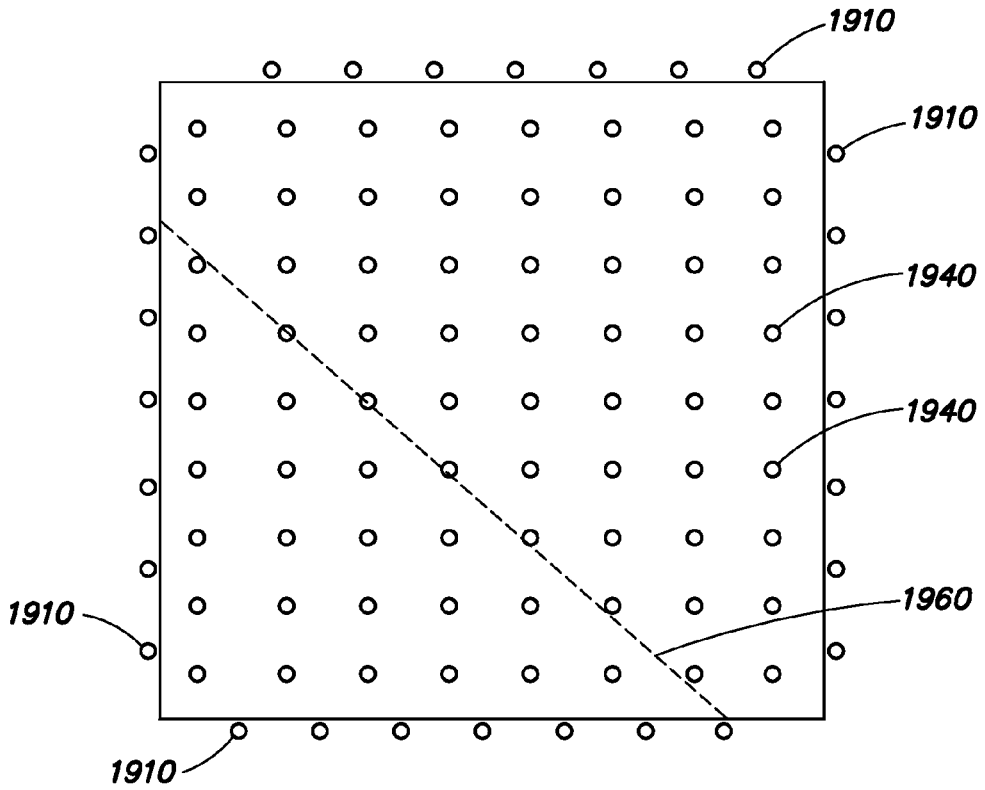
FIG. 19A is a top view of the same implementation.
Figure 19B:
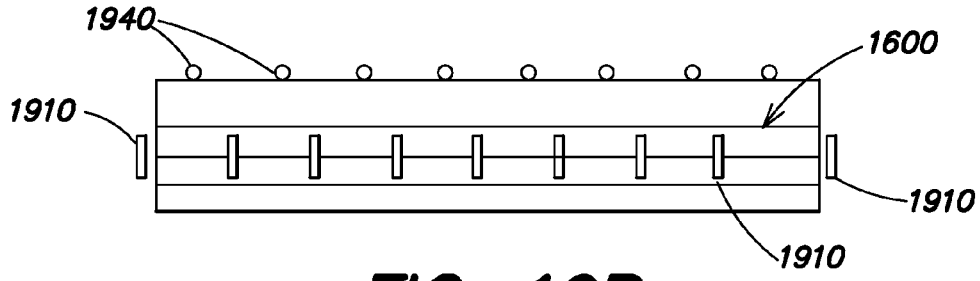
FIG. 19B is a side view, again of the same.

As shown in FIG. 19A (a top view) and FIG. 19B (a side view), a square slab waveguide 1600 (again, formed of multiple dielectric layers as per FIG. 16) is used in which the exciting elements 1910 are mounted along the sides of the waveguide. The exciting elements (vertically polarized) 1940 of two adjacent sides are used to generate a plane wave excitation in the slab as shown by the dotted line 1960 in FIG. 19A. A plane wave 1620 in any direction can be generated by the use of the exciting elements 1910 on the appropriate two adjacent sides.

The exciting elements 1910 should have beam widths of 90° to guarantee uniform coverage over the azimuthal plane. Mounted on the top surface of the slab waveguide 1600 are so-called scattering elements 1940 which intercept a small amount of the plane wave excitation and reradiate the power. The system thus operates as a leaky wave structure.

The scattering elements 1940, which should exhibit hemispherical patterns, can be circularly polarized crossed dipoles are arranged in a Cartesian grid pattern, as shown.

As in the implementations described above, one can control the propagation constant in the slab using the actuators (not shown in FIG. 19A), and thus determine the elevation angle of the beam, while here the direction of the plane wave in the azimuthal plane defines the azimuthal angle of the beam.

(B) Circular Symmetry Implementations

Figure 20A:
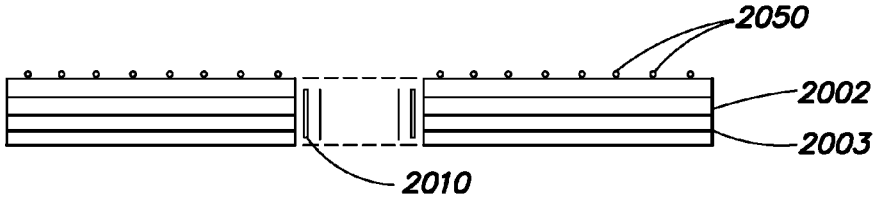
FIGS. 20A, 20B, and 20C are cross-sectional, top and side views of the another implementation using circular array elements.
Figure 20B:
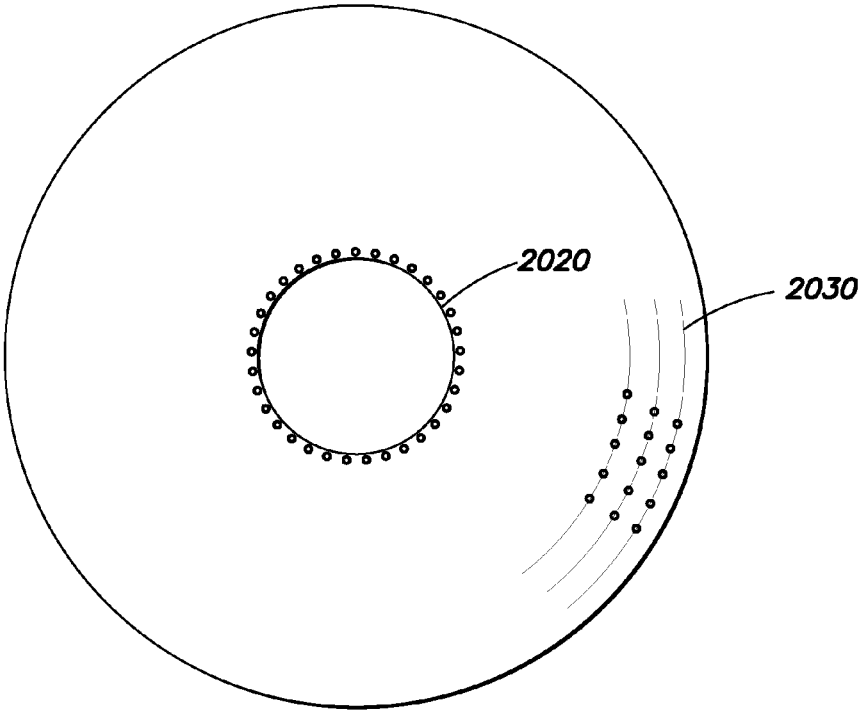
Figure 20C:
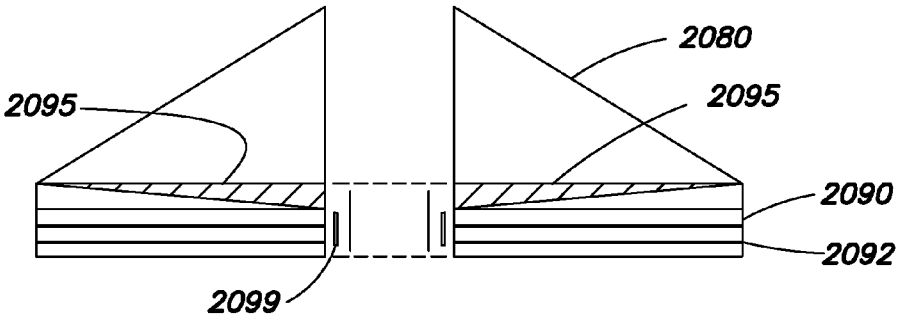

The implementations shown in FIGS. 20A, 20B and 20C provide circular symmetry as: 1) a "flat" circular slab version and 2) a "conical wedge" version.

The flat circular case in FIGS. 20A and 20B uses a circular slab waveguide with a hole in the center for the exciting elements, a commutator, and a beam former. As in a generic circular array, the beam former feeds a sector of exciting vertically polarized elements 2010 to obtain a narrow beam in the direction of that sector, while the commutator 2020 selects the sector direction. The scattering elements are configured in concentric circles 2030 (only partially shown for clarity), keeping the number of elements in each concentric circle constant. The elevation angle of the beam is determined by the propagation constant of the slab waveguide 2002 with configurable gaps 2003 as determined by the gap width, which is controlled by the gap actuators. The azimuthal angle of the beam is determined by the position of the commutator 2020. As in the Cartesian case of FIG. 19A (A), the scattering elements 2050 should have a pattern providing hemispherical coverage.

The wedge version shown in FIG. 20C provides wideband coverage using a conical wedge 2080 as a progressive delay element. The wedge 2080 is situated on top of the circular slab waveguide 2090 with configurable gaps 2092. An exponential coupling layer 2095 is introduced between the wedge and the slab waveguide. The exponential layer 2095 is needed to generate a uniform plane wave across the wedge 2080. No scattering elements are needed since the layer and the high dielectric constant of the wedge provide a leaky structure. The elevation angle of the beam is, as in the flat slab version of FIGS. 20A and 20B, determined by the propagation constant of the slab waveguide as determined by the gap width. Since no scattering elements are used, arbitrary polarization can be provided in the main beam by introducing circularly polarized exciting elements 2099, or combine vertical and horizontal elements such as crossed bowties.

What is claimed is:

1. An antenna apparatus comprising:

a dielectric waveguide formed of two or more layers, with gaps formed between the layers;

a control element arranged to adjust a size of at least one of the gaps, where the control element includes at least one piezoelectric, electroactive material, or mechanical position control;

a plurality of radiating antenna connections disposed adjacent the waveguide; and a plurality of couplers, with a coupler disposed between the dielectric waveguide and each radiating antenna connection.

2. The apparatus of claim 1 additionally comprising:

a delay element disposed between each coupler and radiating antenna connection.

3. The apparatus of claim 1 wherein the dielectric waveguide additionally comprises:

a pair of elongated, rectangular waveguides, each waveguide having a top surface, a bottom surface, an excitation end, and a load end.

4. The apparatus of claim 3 wherein the radiating antenna connections are disposed between each of the pair of waveguides along the top surface.

5. The apparatus of claim 4 wherein each coupler is disposed between a selected one of the pair of waveguides and a selected one of the radiating antenna connections.

6. The apparatus of claim 5 wherein each coupler is a quadrature coupler.

* * * * *